United States Patent [19]

Hirosawa et al.

[11] Patent Number: 4,948,352

[45] Date of Patent: Aug. 14, 1990

[54] ROTOR UNIT WITH PERIPHERAL PROJECTIONS AND CLEARANCES FOR CENTRIFUGAL DEFLECTION

[75] Inventors: Koichiro Hirosawa, Kariya; Makoto Shirai, Toyohashi, both of Japan

[73] Assignee: Aisin Seiki Kabushiki Kaisha, Kariya, Japan

[21] Appl. No.: 245,622

[22] Filed: Sep. 16, 1988

[30] Foreign Application Priority Data

Sep. 25, 1987 [JP] Japan ..... 62-241329
Sep. 25, 1987 [JP] Japan ..... 62-147262[U]

[51] Int. Cl.[5] ..... F01C 1/10; F01C 19/00; F01C 21/08

[52] U.S. Cl. ..... 418/109; 418/168; 418/270

[58] Field of Search ..... 418/83, 168, 179, 104, 418/108, 109, 143, 270, 166, 167, 169–171, 182; 74/413

[56] References Cited

U.S. PATENT DOCUMENTS 1,599,778 9/1926 Loftus ..... 418/168
1,970,146 8/1934 Hill ..... 418/168
3,209,738 4/1962 Clar ..... 418/168
3,563,679 2/1971 Richardson ..... 418/166

FOREIGN PATENT DOCUMENTS 61-4802 1/1986 Japan .
528628 11/1940 United Kingdom ..... 418/83

*Primary Examiner*—John J. Vrablik
*Attorney, Agent, or Firm*—Burns, Doane, Swecker & Mathis

[57] ABSTRACT

A rotor unit comprises an inner rotor and an outer rotor having different number of teeth, with the inner and the outer rotor being mounted on eccentric shafts to be driven for rotation at different speeds. The volume efficiency is improved by producing a clearance between the external surface of the outer rotor and the inner surface of the housing so that the clearance changes from the axial center to either end so that the magnitude of the clearance is reduced during a high speed rotation when a centrifugal force is effective. Projections are formed on the opposite ends of the outer rotor to reduce the volume of a waste space which is defined between the inner and the outer rotor.

7 Claims, 7 Drawing Sheets

ROTOR UNIT WITH PERIPHERAL PROJECTIONS AND CLEARANCES FOR CENTRIFUGAL DEFLECTION

BACKGROUND OF THE INVENTION

The invention relates to a rotor unit including a pair of rotatable members, which are an inner and an outer rotor, and which can be utilized as a rotary piston to form an air compressor or a rotary engine, in particular, to an improvement of the clearance between the outer rotor and a housing and of a rotor configuration.

A rotor unit of the kind described is disclosed, for example, in Japanese Laid-Open Patent Application No. 4,802/1986, which claims a Convention priority of June 12, 1984 based on Swiss Application (CH) 2822/84-8. The disclosed rotor unit is illustrated in FIG. 4*a*. As shown, it comprises a housing 1, an outer rotor 2 and an inner rotor 3. The outer rotor 2 is integrally formed of three sector-shaped members 2*a*, 2*b* and 2*c*, and is rotatably carried by a shaft 2*d* which is centrally disposed. The inner rotor 3 is disposed inside the outer rotor 2 and is rotatably carried by a shaft 3*a* which is offset from or eccentric with respect to the shaft 2*d*. Both the outer rotor 2 and the inner rotor 3 are simultaneously driven for rotation so that the inner rotor 3 rotates at a rate which is one and one-half times greater than the speed of the outer rotor 2, whereby a meshing engagement occurs therebetween to undergo a rotating process as illustrated in FIGS. 4*a* to 4*f*. Thus, when the outer rotor 2 and the inner rotor 3 are driven in a direction of an arrow AR1, fluid, which is generally air, is drawn through a suction inlet 1*a* and displaced toward a discharge outlet 1*b*, both formed in the housing 1, enabling the rotor unit to function as a pump.

However, in a pump which utilizes a rotor unit of the kind described, there is an inconvenience that it suffers from a reduced volume efficiency less than a conventional pump in that the capacity of the fluid being conveyed per cycle is small in comparison to the size of the unit.

SUMMARY OF THE INVENTION

It is an object of the invention to improve the volume efficiency of a rotor unit as disclosed in Japanese Laid-Open Patent Application No. 4,802/1986.

The above object is accomplished in one embodiment of the invention by providing a rotor unit comprising a hollow housing member, an outer rotor member rotatably journalled within the housing member, and an inner rotor member disposed inside the outer rotor member and rotatably carried by a rotary shaft which is disposed eccentrically with respect to a rotary shaft associated with the outer rotor member and having a configuration which allows its meshing engagement with the outer rotor member, a clearance being defined between opposing surfaces of the housing member and the outer rotor member where the internal surface of the housing member and the external surface of the outer rotor member are configured so that the clearance is greater at its center than at its opposite ends as viewed in the axial direction of the rotary shaft associated with the outer rotor member.

Referring back to FIG. 4*a*, the outer rotor 2 comprises three pillar members 2*a*, 2*b*, 2*c* which are sector-shaped in section. All of these pillar members are carried at their opposite ends as viewed axially of the rotary shaft, for integral rotation. In a unit of the kind described, a clearance is defined between the external surface of the outer rotor and the internal surface of the housing 1 to avoid a contact therebetween. However, if the clearance is large, it gives rise to a fluid leakage, reducing the volume efficiency when functioning as a pump. Accordingly, in the usual practice, the clearance is minized by utilizing a precision machining of the external surface of the outer rotor and the internal surface of the housing to a flat form.

In a rotor unit as illustrated in FIG. 4*a*, the outer rotor 2 comprises a hollow construction, whereby during the rotation of the outer rotor 2 at a high speed, the three pillar members 2*a*, 2*b*, 2*c*, which form together the outer rotor, are subject to a centrifugal force, causing an axial deflection of each pillar member which is supported at its opposite ends. Accordingly, the clearance between the external surface of each pillar member and the internal surface of the housing 1 is reduced around the axial center during its rotation, causing a likelihood that a contact of the outer rotor with the housing may occur. To eliminate such contact, it is obliged that the clearance therebetween be chosen greater than is required for the machining accuracy.

In accordance with the invention, the clearance between the internal surface of the housing and the external surface of the outer rotor is chosen to be greater at the axial center than at its opposite ends, thus eliminating the likelihood that the outer rotor may move in contact with the housing during the actual use, namely, when it is subject to a centrifugal force. In addition, the overall clearance is reduced even during the use, thus avoiding a reduction in the volume efficiency.

FIGS. 5*a* and 5*b* illustrate the configuration of an outer rotor A, housings B1, B2 and clearances C1 and C2 of a typical prior art and one embodiment of the invention, respectively, during rotation at a high speed, showing the degree of deflection in an exaggerated form. It will be seen that the clearance can be substantially reduced during use when the configuration according to the invention (FIG. 5*b*) is employed.

The described object is accomplished in one embodiment of the invention by providing a rotor unit comprising a hollow housing member, an outer rotor member rotatably mounted within the housing member and including at least three sector-shaped sections, as viewed in a plane perpendicular to an associated rotary shaft and each having its center located outside the rotary shaft so as to be symmetrical with each other with respect to the rotary shaft, and an inner rotor member located inside the outer rotor member and rotatably carried by a rotary shaft which is eccentric with respect to the rotary shaft of the outer rotor member and configured to achieve a meshing engagment with the sector-shaped segments of the outer rotor member. In accordance with the invention, a projection is formed adjacent to each end of an arc which defines the sector-shaped section and which extends beyond a line joining the center of the sector and such end of the arc, as viewed in the circumferential direction.

Referring back to FIG. 4*b*, it will be noted that an internal surface 1*c* of the housing, an internal wall surface $2c_1$ of the outer rotor and an external surface 3*b* of the inner rotor define a space 4. The space 4 changes its configuration depending on the angle of rotation of the outer and the inner rotor, but continues to exist at any angle throughout the conditions illustrated in FIGS. 4*a* to 4*d*. Under the condition shown in FIG. 4*a*, the space faces the discharge outlet 1*b* while it faces the suction inlet 1*a* under the condition shown in FIG. 4*d*. Thus, as the outer rotor 2 and the inner rotor 3 rotate, the air present within the discharge outlet 1*b* is returned to the suction inlet la through the space 4. In this manner, the presence of the space 4 reduces the amount of air delivered from the suction inlet 1*a* to the discharge outlet 1*b*. Accordingly, by providing a projection in a region of the outer rotor 2 which faces the space 4 so as to extend toward the space 4 with a configuration and a size chosen to avoid an interference with the rotation of the outer and the inner rotor, the volume of the space 4 can be reduced, thereby enabling an improvement in the volume efficiency of the rotor unit.

Other objects and features of the invention will become apparent from the following description of an embodiment thereof with reference to the drawings.

DETAILED DESCRIPTION OF PREFERRED EMBODIMENTS

Figure 2A:
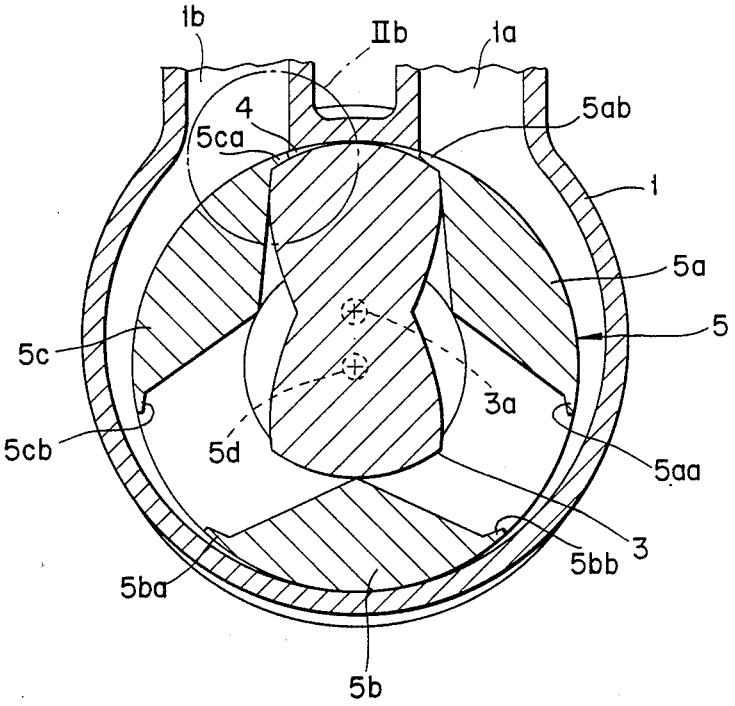
FIG. 2*a* is a cross section taken along the line II—II shown in FIG. 3.
Figure 2B:
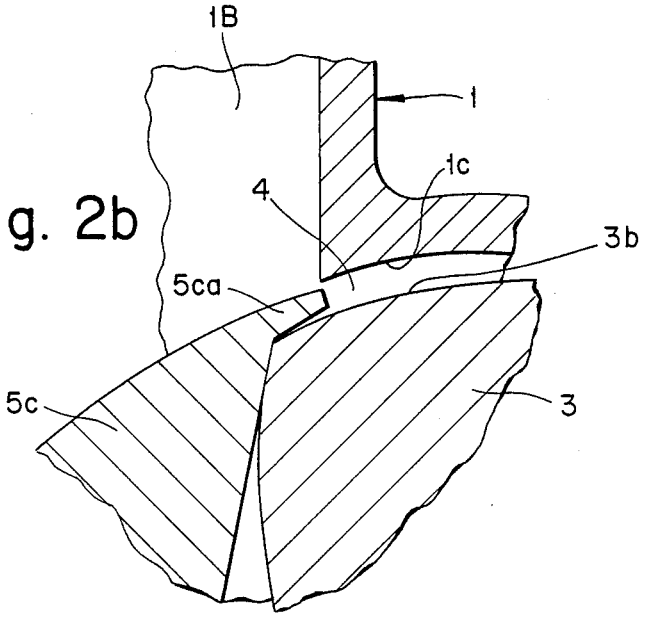
FIG. 2*b* is an enlarged section of a region encircled by character II in FIG. 2*a*.
Figure 3:
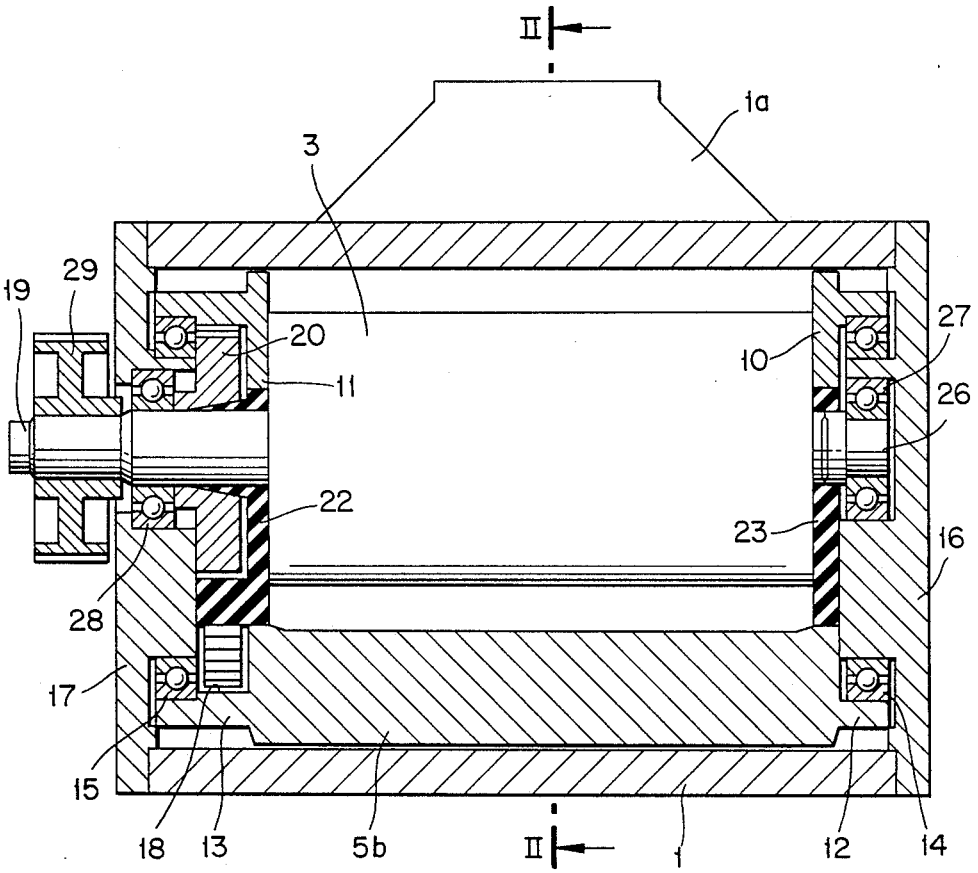
FIG. 3 is a longitudinal section of a rotor unit according to an embodiment of the invention.

FIG. 3 is a longitudinal section of a rotor unit according to one embodiment of the invention. FIG. 2*a* shows a section taken along the line II—II shown in FIG. 3, and FIG. 2*b* shows a region II*b* encircled in FIG. 1 to an enlarged scale. It is to be noted that similar parts to those shown in FIGS. 4*a* to 4*f* are designated by like reference characters.

Initially referring to FIGS. 2*a* and 3, the rotor unit comprises a housing 1, an outer rotor 5 and an inner rotor 3, as shown in FIG. 3. The housing 1 is in the form of a hollow cylinder having its opposite ends closed by sideplates 16 and 17. A pair of shafts 19 and 26 extend from the opposite ends of the inner rotor 3 and are carried by ball bearings 28, 27, respectively, which are supported by the sideplates 16, 17 of the housing 1.

The outer rotor 5 comprises three pillar members 5*a*, 5*b*, 5*c* which are substantially sector-shaped as illustrated in FIG. 2*a* when taken through a plane perpendicular to a rotary shaft thereof, and a pair of sideplates 10, 11 integrally secured to the opposite ends of these pillar members. At its opposite ends, the sideplates 10, 11 are formed with externally extending hubs 12 and 13, respectively. The outer rotor 5 is rotatably carried by the sideplates 16, 17 of the housing 1 through interposed ball bearings 14, 15, in the regions of the hubs 12, 13. Around its inner periphery, the hub 13 is formed with an internal gear 18, which meshes with a gear 20 fixedly mounted on the shaft 19. The meshing engagement between the gear 20 and the internal gear 18 allows a drive applied to the shaft 19 to be transmitted to the outer rotor 5 with a speed reduction so that the inner rotor rotates at a speed which is one and one-half times greater than that of the outer rotor. As shown in FIG. 2*a*, the rotary shaft 3*a* of the inner rotor and the rotary shaft 5*d* of the outer rotor are offset from or eccentric with respect to each other. In FIG. 3, sealing plates are shown at 22 and 23 while numeral 29 represents a power transmission gear.

Figure 1:
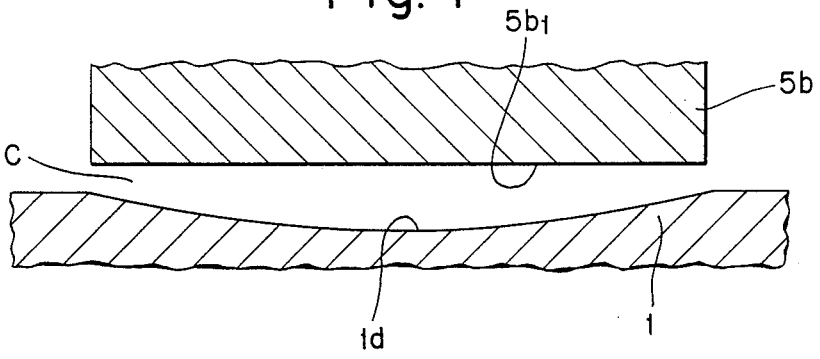
FIG. 1 is a fragmentary section, illustrating part of FIG. 3 to an exaggerated scale.
Figure 4A:
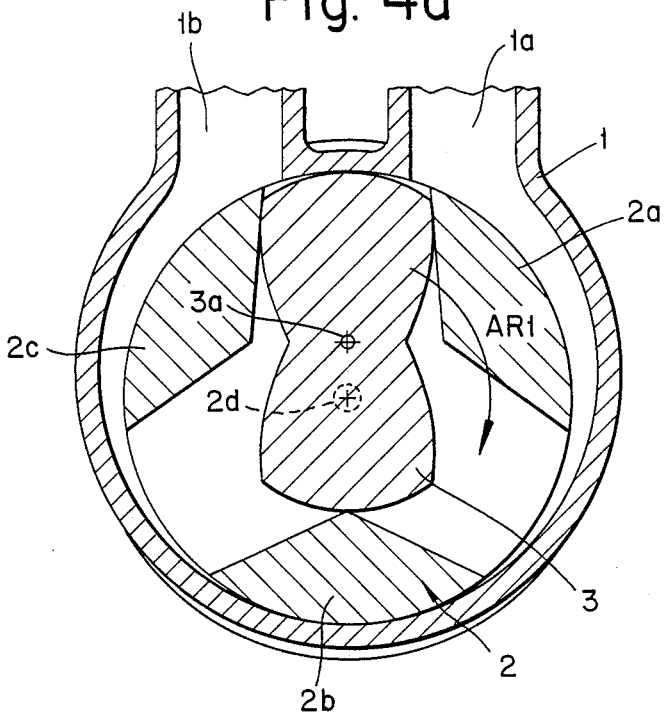
FIGS. 4*a*, 4*b*, 4*c*, 4*d*, 4*e* and 4*f* are sections, taken through planes perpendicular to the rotary shaft of the rotor, schematically illustrating the operation of the rotor unit.
Figure 4B:
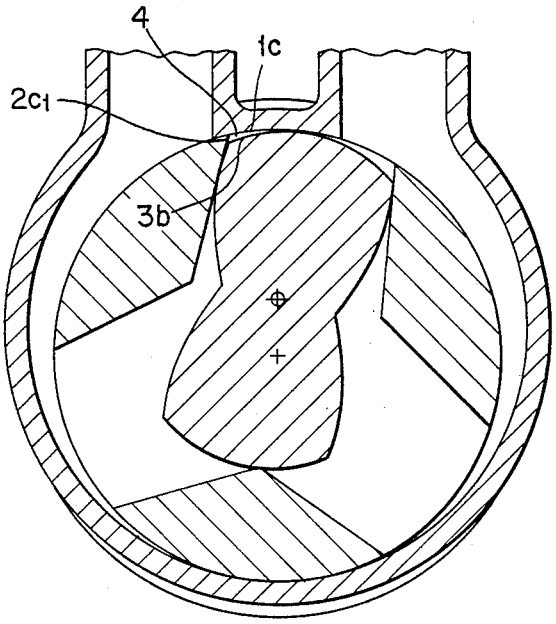
Figure 4C:
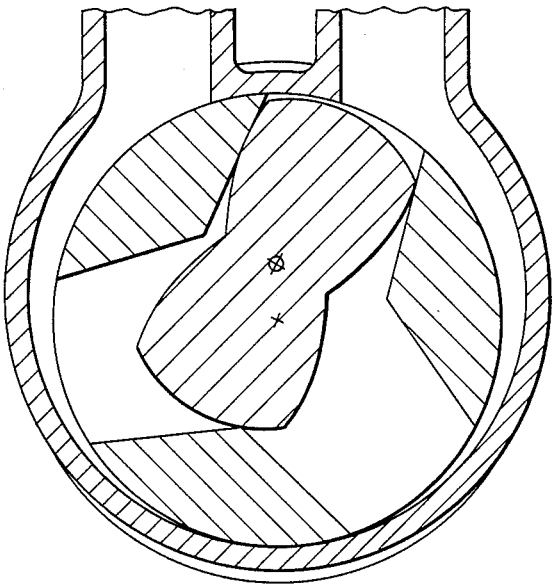
Figure 4D:
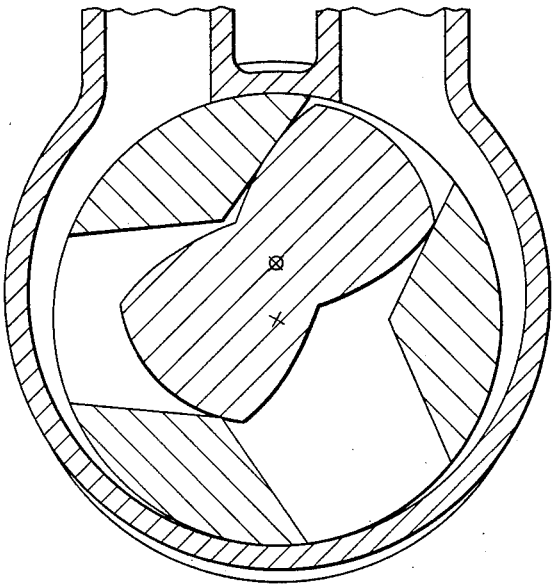
Figure 4E:
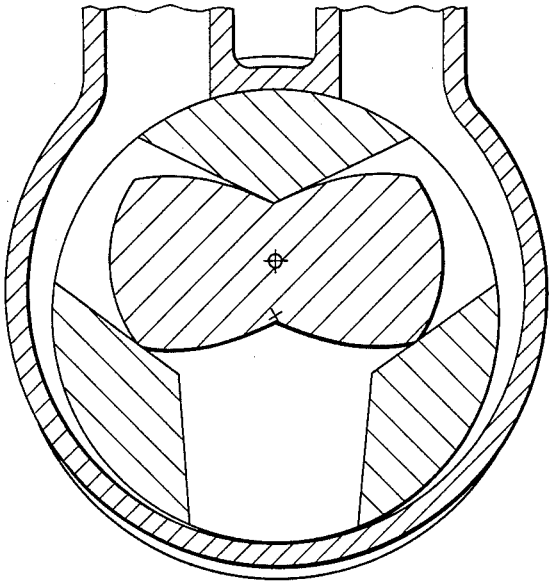
Figure 4F:
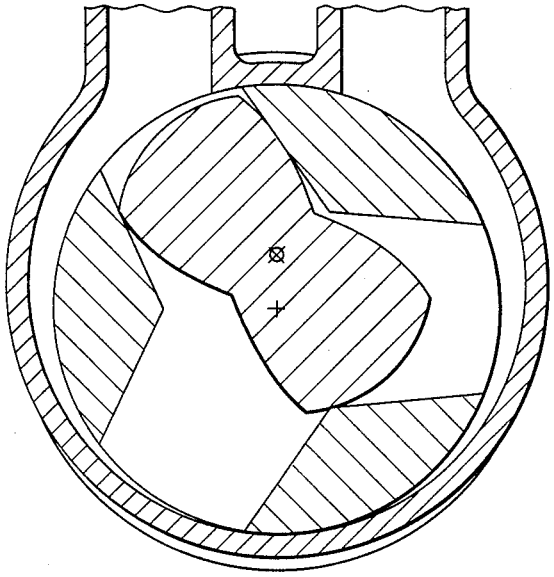

The rotor unit shown in FIGS. 1 to 3 can be driven through the gear 29 to rotate the outer rotor 5 and the inner rotor 3 at a given speed ratio so as to function as a pump, allowing the air to be delivered from a suction inlet 1*a* to a discharge outlet 1*b*, both formed in the housing 1. Thus, the rotation of the inner and the outer rotor is effective to deliver the air from the inlet 1*a* to the outlet lb by a function similar to that described previously in connection with FIGS. 4*a* to 4*f*. The capacity of fluid which is conveyed per revolution of the rotor is determined by the size of the space defined between the outer rotor 5 and the inner rotor 3. However, in a rotor unit of the kind described, the air is also conveyed in a direction from the outlet 1*b* to the inlet 1*a* at the same time as the air is delivered from the inlet 1*a* to the outlet 1*b*. As mentioned previously, the space 4 is defined by the internal surface 1*c* of the housing, the inner wall surface $2c_1$ of the outer rotor and the external surface 3*b* of the inner rotor as shown in FIG. 4*b*. The space 4 changes its configuration depending on the angle of rotation of the outer rotor 5 and the inner rotor 3, but remains to be present at any angle throughout the conditions shown in FIGS. 4*a* to 4*d*. Thus, the space faces the outlet 1*b* under the condition in FIG. 4*a* while it faces the inlet 1*a* under the condition shown in FIG. 4*b*. Consequently, when the outer rotor 5 and the inner rotor 3 rotate, the air present in the outlet 1*b* is returned to the inlet 1*a* through the space 4. Thus, the presence of the space 4 reduces the amount of air which is delivered from the inlet 1*a* to the outlet 1*b* in comparison to the amount of air which can be delivered in the absence of such space.

To avoid this, in the present embodiment, the pillar members 5*a*, 5*b*, 5*c* are specially configured in a manner illustrated in FIG. 2*a* and 2*b*. Thus, while the pillar members 5*a*, 5*b*, 5*c* are generally sector-shaped in section, considering the pillar member 5*c*, by way of example, projections 5*ca* and 5*cb* are formed adjacent to the opposite ends of the arc which defines the sector configuration. These projections extend into the space 4, thus reducing the volume of the space 4 by an amount corresponding to the size of these projections. Similarly, the pillar member 5*a* is formed with projections 5*aa* and 5*ab* and the pillar member 5*b* is formed with projections 5*ba* and 5*bb*. The configuration of these projections can be changed as desired provided their configuration and size do not interfere with the rotation of the outer and the inner rotor. In the present embodiment, the projections formed on the pillar members 5*a*, 5*b*, 5*c* reduce the volume of the space 4, thus reducing the capacity of fluid which is returned from the outlet 1*b* to the inlet 1*a*.

It will be recognized that during the rotation of the outer rotor 5 at a high speed, the resulting centrifugal force urges the respective pillar members 5*a*, 5*b*, 5*c* radially outward. However, the opposite ends of the respective pillar members remain immovable since they are secured to the sideplates 10, 11. Accordingly, a portion thereof or an axially central portion thereof which is not secured will be flexed outward. If each pillar member moves then into contact with the internal surface of the housing, the rotation of the outer rotor will be prevented. Accordingly, there must be a clearance therebetween in order to avoid a contact therebetween. The magnitude of such clearance must be greater than the deflection of the pillar members. On the other hand, the presence of such clearance causes a fluid leakage between the inlet 1*a* and the outlet 1*b*, and the volume efficiency of the rotor unit will be degraded in proportion to the magnitude of such clearance. It is found by experiment that the leakage increases in proportion to the third power of the clearance.

Figure 5A:
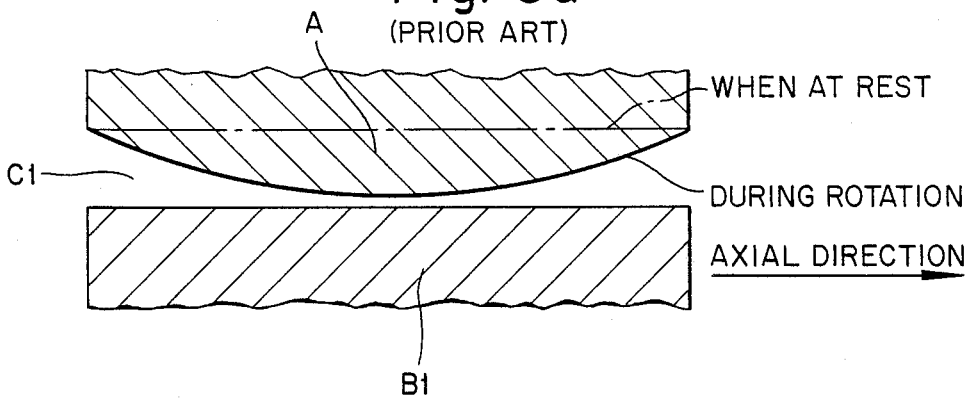
Fig. 5a (PRIOR ART)
FIGS. 5*a* and 5*b* are fragmentary sections, illustrating the configuration of the outer rotor, housing and clearance according to a typical prior art and according to one embodiment of the invention.
Figure 5B:
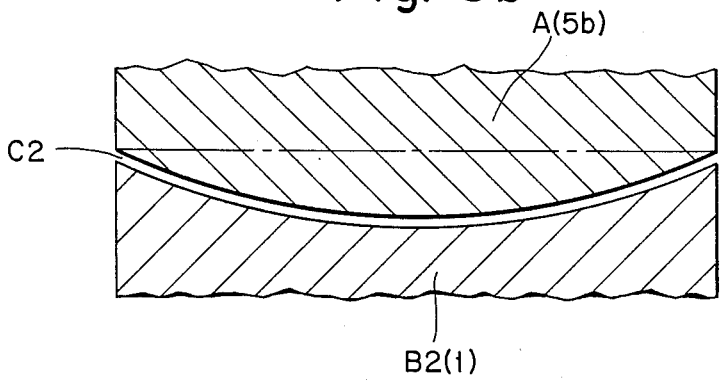

Accordingly, a sophistication is made in the configuration to minimize the clearance. Specifically, FIG. 1 shows part of FIG. 3 in an exaggerated form. In this Figure, a portion of the internal surface 1*d* of the housing 1 which is located opposite to the outer rotor (5*b*) is smoothly recessed, whereby the clearance C between the housing 1 and the outer rotor is reduced toward its opposite ends and is maximum at its center. Specifically, the internal surface of the housing 1 is formed so that the magnitude of the clearance is uniform throughout the axial length when the outer rotor rotates at a high speed and the pillar member 5*b* thereof becomes flexed as illustrated in FIG. 5*b*. Such configuration can be determined according to the formula (1) given below. In this formula, y represents a distance from the center of rotation of the outer rotor to the internal surface of the housing, L the length of the pillar member measured from its one end to the other end, x a distance to an axial point on the pillar member from its one end, d/2 the radius of the outer rotor, and c the magnitude of clearance at the opposite ends. It is to be noted that this formula applies in a range defined by the inequality $0 \leqq x \leqq L/2$.

$$y = \left(\frac{d}{2} + c\right) + k \cdot \frac{wL^4}{24EI}\left(\frac{x^2}{L^2} - \frac{2x^3}{L^3} + \frac{x^4}{L^4}\right) \quad (1)$$

where k represents a constant representing an experimental value in a range from 2 to 5 which depends on the configuration of clamping bolts, the number of bolts, and the magnitude of torques with which the bolts are clamped, E a longitudinal elastic modulus of the rotor, I the section moment about the center of gravity of the rotor, w the centrifugal force ($=mr\,\omega^2$) per unit length of the rotor, m the mass per unit length of the rotor, r the length from the center of rotation to the center of gravity of the rotor and $\omega$ the angular velocity. It is assumed that the configuration of the surface 1*d* is symmetrical with respect to the axial center. In a range $L/2 \leqq x < L$, y decreases with an increase of x.

Figure 6A:
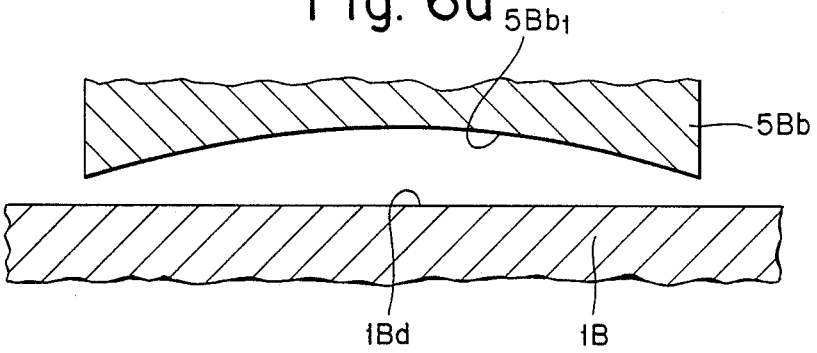
FIGS. 6*a* and 6*b* are fragmentary sections of the outer rotor, housing and clearance of modifications.
Figure 6B:
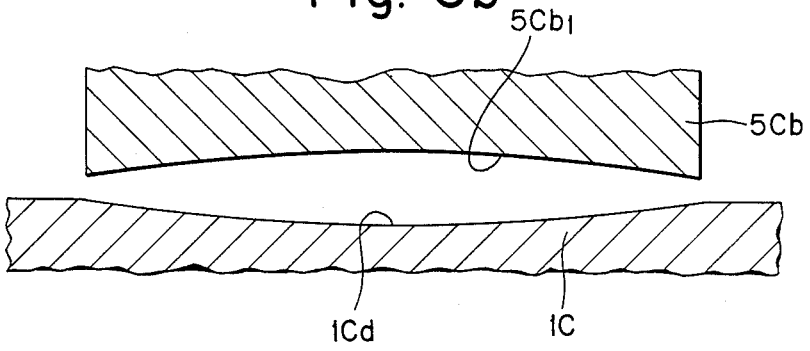

FIGS. 6*a* and 6*b* illustrate modifications of the invention. In FIG. 6*a*, the internal surface 1B*b* of a housing 1B is generally flat in the axial direction while the external surface 5B*b*$_1$ of the outer rotor is curved in the axial direction. In FIG. 6*b*, the internal surface 1C*b* of a housing 1C and the external surface 5C*b*$_1$ of the outer rotor are both curved in the axial direction. In each instance, when the unit is at rest, the clearance is greater at the center than at its opposite ends as viewed in the axial direction. Accordingly, during a steady-state rotation, the clearance is reduced over the axial length as illustrated in FIG. 5*b*.

The recess which is formed in the internal surface of the housing and/or the external surface of the outer rotor is most preferably represented by a smooth curves according to the formula (1), but the machining can be facilitated by employing a broken line approximation of such curve.

As described, in accordance with the invention, the actual clearance between the housing and the outer rotor can be reduced even when the hollow outer rotor is greatly deformed due to the centrifugal force, thus improving the volume efficiency of the rotor unit. The volume efficiency can be further improved by providing projections on the rotor.

WHAT WE CLAIMED IS:

1. A rotor unit comprising a hollow housing member, an outer rotor member rotatably carried within the housing member and an inner rotor member disposed inside the outer rotor member and rotatably carried by a rotary shaft which is eccentric with respect to a rotary shaft associated with the outer rotor member and configured for meshing engagement with the outer rotor member, a clearance being defined between the opposing surfaces of the housing member and the outer rotor member at rest in a manner such that the clearance is greater at the center the clearance being at a minimum at opposite ends of the outer rotor member, as viewed in the axial direction of the rotary shaft of the outer rotor member, than at its opposite ends or the entire periphery of the outer rotor member.

2. A rotor unit according to claim 1 in which at least one of the internal surface of the housing member and the external surface of the outer rotor member is substantially curved in the axial direction of the rotary shaft of the outer rotor member in the region of the opposing surfaces of the housing member and the outer rotor member.

3. A rotor unit according to claim 1 in which the outer rotor member includes at least three sector-shaped sections, as viewed in a plane perpendicular to the rotary shaft and which are symmetrical to each other with respect to the rotary shaft, the sector-shaped sections being disposed so that their centers are located outside the rotary shaft.

4. A rotor unit comprising a hollow housing member, an outer rotor member rotatably carried within the housing member and including at least three sector-shaped sections, each sector configuration defined by two radii and one arc segment of the outer rotor as view in a plane perpendicular to a rotary shaft associated with the outer rotor member and which are symmetrical to each other with respect to the rotary shaft, the sector-shaped sections being disposed so that their centers are located outside the rotary shaft, and an inner rotor member disposed inside the outer rotor member and rotatably carried by a rotary shaft which is eccentric with respect to the rotary shaft associated with the outer rotor member and configured for meshing engagement with the sector-shaped sections of the outer rotor member; and projections formed adjacent to the respective ends of an arc which defines the sector configuration and extending away from the sector-shaped section and protruding away from a plane surface containing the radii which define the sector configuration.

5. A rotor unit comprising a hollow housing member, an outer rotor member rotary carried within the housing member and an inner rotor member disposed inside the outer rotor member and rotatably carried by a rotary shaft which is eccentric with respect to a rotary shaft associated with the outer rotor member and configured for meshing engagement with the outer rotor member, a clearance being defined between the opposing surfaces of the housing member and the rotor outer rotor member at rest in a manner such that the clearance is greater at the center by a predetermined amount corresponding to an amount of distortion to which the outer rotor is subject due to centrifugal force during rotation, as viewed in the axial direction of the rotary shaft of the outer rotor member, than at its opposite ends.

6. A rotor unit according to claim 5 in which at least one of the internal surface of the housing member and the external surface of the outer rotor member is substantially curved in the axial direction of the rotary shaft of the outer rotor member in the region of the opposing surface of the housing member and the outer rotor member.

7. A rotor unit according to claim 5 in which the outer rotor member includes at least three sector-shaped sections, as viewed in a plane perpendicular to the rotary shaft and which are symmetrical to each other with respect to the rotary shaft, the sector-shaped sections being disposed so that their centers are symmetrical with reference to the rotary shaft.

* * * * *